US011530126B2

(12) United States Patent
Ye et al.

(10) Patent No.: US 11,530,126 B2
(45) Date of Patent: Dec. 20, 2022

(54) DISTRIBUTOR

(71) Applicant: Ningbo Major Draft Beer Equipment Co., Ltd., Ningbo (CN)

(72) Inventors: Xiaoyang Ye, Ningbo (CN); Bangcai Luo, Ningbo (CN)

(73) Assignee: Ningbo Major Draft Beer Equipment Co., Ltd, Ningbo (CN)

( * ) Notice: Subject to any disclaimer, the term of this patent is extended or adjusted under 35 U.S.C. 154(b) by 0 days.

(21) Appl. No.: 17/537,402

(22) Filed: Nov. 29, 2021

(65) Prior Publication Data

US 2022/0298000 A1 Sep. 22, 2022

(30) Foreign Application Priority Data

Mar. 22, 2021 (CN) ..... 202110303667.9
Mar. 22, 2021 (CN) ..... 202120579208.9

(51) Int. Cl.
*B67D 1/12* (2006.01)
*B67D 1/14* (2006.01)
*B67D 1/08* (2006.01)

(52) U.S. Cl.
CPC ..... *B67D 1/1277* (2013.01); *B67D 1/1477* (2013.01); *B67D 2001/0822* (2013.01)

(58) Field of Classification Search
CPC ..... B67D 1/1277; B67D 1/1477; B67D 2001/0822
See application file for complete search history.

(56) References Cited

U.S. PATENT DOCUMENTS 3,596,809 A * 8/1971 Taubenheim ..... B67D 1/0831 137/212
3,596,810 A * 8/1971 Taubenheim ..... B67D 1/0832 137/212
5,511,692 A * 4/1996 Willingham ..... B67D 7/0294 141/351
6,367,667 B1 * 4/2002 Ipsen ..... B67D 1/0832 222/509
7,832,596 B2 * 11/2010 van der Klaauw .. B67D 1/0832 222/394
10,370,569 B2 * 8/2019 Yin ..... C08G 61/12
10,882,726 B2 * 1/2021 Ye ..... B67D 1/125
10,882,729 B2 * 1/2021 Ye ..... F16K 17/04

* cited by examiner

*Primary Examiner* — Frederick C Nicolas
(74) *Attorney, Agent, or Firm* — Wood, Phillips, Katz, Clark & Mortimer

(57) ABSTRACT

The disclosure herein discloses a distributor, which includes a keg head, a valve element, an elastic member, and a valve element switch configured to control the valve element to act. The keg head is provided with a liquid inle, a liquid outlet, and a valve element mounting hole. The valve element includes a control portion controlling the communication or disconnection between the liquid inlet and the liquid outlet and a switch connecting portion configured to be connected to the valve element switch. The valve element is provided with a first matching body. The valve element switch is provided with a second matching body. The elastic member acts on the valve element such that the first matching body tends to move to abut against the second matching body. According to the disclosure herein, the valve element is in floating connection to the valve element switch.

10 Claims, 5 Drawing Sheets

DISTRIBUTOR

TECHNICAL FIELD

The disclosure herein relates to the field of kegs for keeping beer fresh, and particularly to a distributor.

BACKGROUND

A distributor is matched with a keg spear of a beer keg to control an open/closed state of the keg spear. With the upgrading of distributors, distributors capable of adjusting beer flows usually by the movement of valve elements in passages thereof have emerged at present. An operator operates a valve element switch connected to the valve element to locate the valve element in the passage. The valve element usually forms a rigid connection to the valve element switch by a screw. In this connection manner, the valve element is relatively likely to be locked in the passage, which affects the use.

SUMMARY

In order to overcome the shortcomings in a conventional art, the disclosure herein provides a distributor. A valve element is in floating connection to a valve element switch, so that the phenomenon that the valve element is locked is effectively avoided.

In order to achieve the above objective, the disclosure herein is implemented by the following technical solutions.

A distributor includes a keg head, a valve element, an elastic member, and a valve element switch configured to control the valve element to act. The keg head is provided with a liquid inlet in fluid communication with a beer keg, a liquid outlet configured for liquid to flow out, and a valve element mounting hole matched with the valve element. The liquid inlet and the liquid outlet are communicated with the valve element mounting hole respectively to implement the communication of the liquid inlet and the liquid outlet through the valve element mounting hole. The valve element includes a control portion movably mounted in the valve element mounting hole to control the communication or disconnection between the liquid inlet and the liquid outlet and a switch connecting portion configured to be connected to the valve element switch.

The valve element is provided with a first matching body. The valve element switch is provided with a second matching body matched with the first matching body. The elastic member acts on the valve element such that the first matching body tends to move to abut against the second matching body.

Further, the valve element switch is provided with a mounting through hole. The switch connecting portion extends into the mounting through hole from an opening in one end of the mounting through hole. A side wall of the switch connecting portion protrudes to an inner wall side of the mounting through hole to form the first matching body. An inner wall of the mounting through hole protrudes to an outer wall side of the switch connecting portion to form the second matching body. The second matching body is located between the first matching body and the control portion. An elastic member limiter is disposed in an opening in the other end of the mounting through hole. Two ends of the elastic member are pressed against the valve element and the elastic member limiter respectively such that the elastic member is deformed by axial pressure.

Further, a mounting opening of the valve element penetrating through the keg head is formed in one end of the valve element mounting hole. The valve element switch is in threaded connection to the end, where the mounting opening of the valve element is disposed, of the keg head. The valve element switch implements the movable adjustment of the valve element linked with the valve element switch in the valve element mounting hole by thread adjustment with the keg head.

Further, the valve element switch includes a thread fitting portion extending into the valve element mounting hole, a switch matching portion outside the keg head, and a switch transition portion configured to connect the thread fitting portion with the switch matching portion. A thread is disposed on an outer wall of the thread fitting portion. A thread matched with the thread of the thread fitting portion is disposed on an inner wall of the valve element mounting hole close to the side of the mounting opening of the valve element.

The switch matching portion is provided with a limiting member protruding to an outer wall side of the keg head. An outer wall of the keg head protrudes to the side of the switch matching portion to form a limiting portion. The limiting portion is located between the limiting member and the switch transition portion.

Further, at least an end of the control portion away from the switch control portion presents a gradually enlarged tapered structure along a direction of getting close to the switch connecting portion. A matched taper hole is disposed at a position, configured to accommodate the tapered structure of the control portion, of the valve element mounting hole.

Further, the switch connecting portion is clamped with the control portion. A first end face of the switch connecting portion facing the control portion is sunken to form a clamping groove. A second end face of the control portion facing the switch connecting portion protrudes to form a clamping protruding block matched with the clamping groove. The first matching body is disposed on the switch connecting portion.

Further, an edge of a second end face of the control portion facing the switch connecting portion is beyond that of a first end face of the switch connecting portion facing the control portion. The second end face forms a second matching body accommodation groove with a third end face of the first matching body facing the second end face. An end face of the second matching body facing the second end face forms a fourth end face. An end face of the second matching body facing the third end face forms a fifth end face. A distance from the second end face to the third end face is greater than that from the fourth end face to the fifth end face.

Further, the distributor includes a distributor seat and an operating device. The distributor seat is provided with a keg head sleeve-connection hole in movable matched sleeve connection to the keg head. The operating device is in matched connection to the distributor seat and the keg head respectively. The keg head is driven by the operating device to slide in the keg head sleeve-connection hole to open and close a corresponding keg spear.

Further, the operating device includes a driving arm and a handle. One end of the driving arm is in matched hinged connection to the distributor seat, while the other end is in matched connection to the handle. A driving block is disposed on an inner side wall of the driving arm facing the keg head. A driving sliding chute matched with the driving block is disposed in a side wall of the keg head facing the driving arm.

Further, the handle includes a fixed handle, a movable handle, an ejector rod, and an ejector rod reset member. The fixed handle is connected to the driving arm. The fixed handle is provided with an ejector rod ferrule hole for sliding of the ejector rod. At least one end of the ejector rod ferrule hole penetrates through the fixed handle to expose an ejector head of the ejector rod. A surface of a vertically distributed stopping plate is provided at a position of the distributor seat close to the ejector head. At least a first stopping slot and second stopping slot which are matched with the ejector head are provided on a side of the stopping plate facing the ejector head.

The movable handle is connected to the ejector rod to drive the ejector head of the ejector rod to get close to or away from the stopping plate. The ejector rod reset member acts on the ejector rod such that the ejector rod tends to move to the side of the stopping plate.

The operating device drives the keg head to close the keg spear when the ejector head of the ejector rod is in the first stopping slot.

The operating device drives the keg head to open the keg spear when the ejector head of the ejector rod is in the second stopping slot.

Further, the movable handle is provided with a handle ferrule hole. The movable handle is in sleeve connection outside the fixed handle by the handle ferrule hole.

Further, an end face at an opening of the handle ferrule hole circumferentially protrudes to form a first cambered bump, and is circumferentially sunken to form a first cambered recess. The first cambered bump is connected to the first cambered recess with a smooth transition formed at a junction. The fixed handle protrudes at the opening of the handle ferrule hole to form a matching surface contacting with the end face at the opening of the handle. The matching surface circumferentially protrudes to form a second cambered bump matched with the first cambered recess, and is circumferentially sunken to form a second cambered recess matched with the first cambered bump.

Further, a cambered buckling plate is disposed at a bottom end of the distributor seat. The cambered buckling plate is provided with a cambered buckling groove horizontally matched and buckled with an annular step on a side edge of a top surface of the keg spear. The distributor seat is provided with an inserted pin at a position where the cambered buckling plate is not disposed. The inserted pin is slidably mounted to the distributor seat. An extending surface of a cambered surface of the cambered buckling groove is tangent to a lateral surface of the inserted pin. The distributor seat is provided with an inserted pin seat at a position where the inserted pin is disposed.

Further, a bottom surface of the keg head is beyond that of the distributor seat when the ejector head of the ejector rod is in the first stopping slot or the second stopping slot. A third stopping slot is further provided on a side of the stopping plate facing the ejector head. The bottom surface of the keg head is not beyond that of the distributor seat when the ejector head of the ejector rod is in the third stopping slot.

Compared with the conventional art, the disclosure herein has the following beneficial effects.

(1) According to the distributor of the disclosure herein, the valve element is in floating connection to the valve element switch through the first matching body, the second matching body and the elastic member, so that the phenomenon that the valve element is locked is effectively avoided.

(2) According to the distributor of the disclosure herein, the first cambered bump and the second cambered bump are disposed between the movable handle and the fixed handle to implement the sliding of the movable handle in a rotating form, so that the distributor is more labor-saving.

Figure 1:
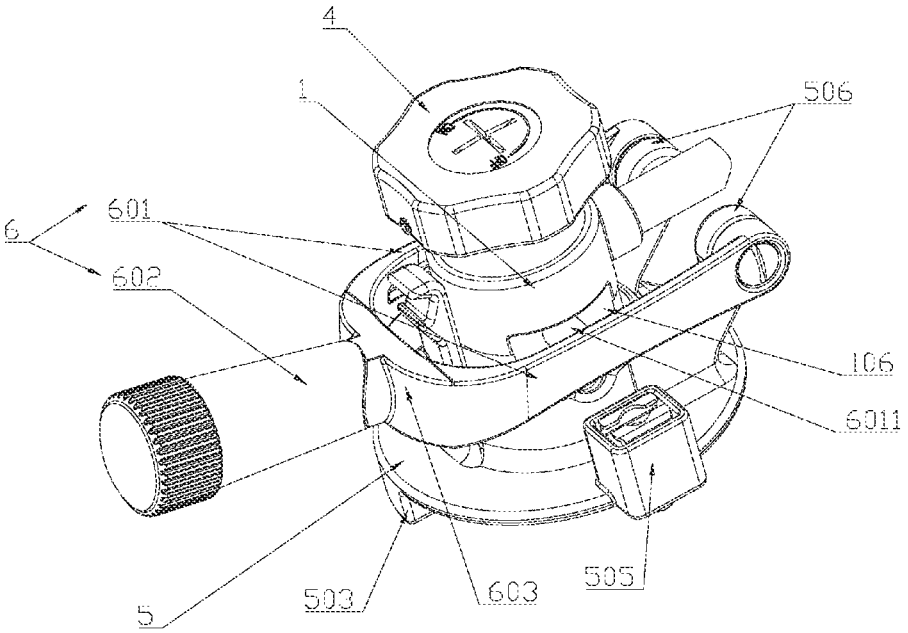
FIG. 1 is a schematic three-dimensional structural diagram of a distributor according to the disclosure herein.

Reference numerals in the drawings: 1—keg head; 101—liquid inlet; 102—liquid outlet; 103—valve element mounting hole; 1031—taper hole; 104—mounting opening of valve element; 105—limiting portion; 106—driving sliding chute; 2—valve element; 201—control portion; 2011—tapered structure; 2012—clamping protruding block; 2013—second end face; 202—switch connecting portion; 2021—clamping groove; 2022—first end face; 203—first matching body; 2031—third end face; 204—second matching body accommodation groove; 3—elastic member; 4—valve element switch; 401—second matching body; 4011—fourth end face; 4012—fifth end face; 402—mounting through hole; 403—elastic member limiter; 404—thread fitting portion; 405—switch matching portion; 406—switch transition portion; 407—limiting member; 5—distributor seat; 501—keg head sleeve-connection hole; 502—stopping plate; 5021—first stopping slot; 5022—second stopping slot; 5023—third stopping slot; 503—cambered buckling plate; 5031—cambered buckling groove; 504—inserted pin; 505—inserted pin seat; 506—support rod; 6—operating device; 601—driving arm; 6011—driving block; 602—handle; 6021—fixed handle; 6021*a*—ejector rod ferrule hole; 6021*a*1—first ejector rod ferrule hole; 6021*a*2—second ejector rod ferrule hole; 6021*b*—matching surface; 6021*b*1—second cambered bump; 6021*b*2—second cambered recess; 6022—movable handle; 6022*a*—handle ferrule hole; 6022*a*1—first handle ferrule hole; 6022*a*2—second handle ferrule hole; 6022*b*—first cambered bump; 6022*c*—first cambered recess; 6023—ejector rod; 6023*a*—ejector head; 6023*b*—large cylindrical section; 6023*c*—small cylindrical section; 6023*c*1—snap spring slot; 6024—ejector rod reset member; 6025—snap spring; 6026—gasket; 603—driving arm connecting belt; 7—keg spear; 701—beer outlet; 702—beer outlet passage; 703—plug; 704—plug reset member; and 705—annular step.

DETAILED DESCRIPTION

Specific implementations of the disclosure herein will further be described below in detail in combination with the drawings and embodiments. The following embodiments are used to describe the disclosure herein rather than limit the scope of the disclosure herein.

As shown in FIGS. 1 to 8, a distributor includes a keg head 1, a valve element 2, an elastic member 3, and a valve element switch 4 configured to control the valve element 2 to act. The keg head 1 is provided with a liquid inlet 101 in fluid communication with a beer keg, a liquid outlet 102 configured for liquid to flow out, and a valve element mounting hole 103 matched with the valve element 2. The liquid inlet 101 and the liquid outlet 102 are communicated with the valve element mounting hole 103 respectively to implement the communication of the liquid inlet 101 and the liquid outlet 102 through the valve element mounting hole 103. The valve element 2 includes a control portion 201 movably mounted in the valve element mounting hole 103 to control the communication or disconnection between the liquid inlet 101 and the liquid outlet 102 and a switch connecting portion 202 configured to be connected to the valve element switch 4.

The valve element 2 is provided with a first matching body 203. The valve element switch 4 is provided with a second matching body 401 matched with the first matching body 203. The elastic member 3 acts on the valve element 2 such that the first matching body 203 tends to move to abut against the second matching body 401.

With the adoption of the above-mentioned structure, the valve element switch 4 is operated to control a position of the valve element 2 in the valve element mounting hole 103 to implement the communication and disconnection between the liquid inlet 101 and the liquid outlet 102. When the liquid inlet 101 is communicated with the liquid outlet 102, liquid enters the keg head 1 from the liquid inlet 101 and flows out of the liquid outlet 102 through the valve element mounting hole 103.

In the above-mentioned structure, the floating connection between the valve element switch 4 and the valve element 2 is implemented through the first matching body 203, the second matching body 401 and the elastic member 3. The elastic member 3 causes the first matching body 203 to tend to move to abut against the second matching body 401, namely the first matching body 203 may always move to abut against the second matching body 401. Therefore, the connection between the valve element switch 4 and the valve element 2 is implemented, namely the valve element switch 4 may control the valve element 2.

If the valve element switch 4 is directly in rigid connection to the valve element 2, namely the valve element 2 and the valve element switch 4 act completely synchronously, the valve element 2 is inclined when the valve element switch 4 is slightly inclined during adjustment, and in such case, the valve element 2 and the valve element mounting hole 103 are easily locked. Compared with the rigid connection between the valve element switch 4 and the valve element 2, the floating connection between the valve element switch 4 and the valve element 2 may effectively eliminate the locking phenomenon. Since the valve element 2 is in movable floating connection to the valve element switch 4, the valve element 2 may be movably adjusted along a direction of the valve element mounting hole 103 under the adjustment of the valve element switch 4 when the valve element switch 4 is slightly inclined during adjustment. However, the valve element mounting hole 103 may limit the valve element 2 to prevent the valve element 2 from being inclined with the valve element switch 4 and further avoid the phenomenon that the valve element 2 is locked.

Preferably, the valve element switch 4 is provided with a mounting through hole 402. The switch connecting portion 202 extends into the mounting through hole 402 from an opening in one end of the mounting through hole 402. A side wall of the switch connecting portion 202 protrudes to an inner wall side of the mounting through hole 402 to form the first matching body 203. An inner wall of the mounting through hole 402 protrudes to an outer wall side of the switch connecting portion 202 to form the second matching body 401. The second matching body 401 is located between the first matching body 203 and the control portion 201. An elastic member limiter 403 is disposed in an opening in the other end of the mounting through hole 402. Two ends of the elastic member 3 are pressed against the valve element 2 and the elastic member limiter 403 respectively such that the elastic member 3 is deformed by axial pressure.

With the adoption of the above-mentioned structure, when an adjustment direction of the valve switch is a direction that the valve element 2 is separated from the valve element mounting hole 103, the second matching body 401 on the valve switch applies a force to the first matching body 203 on the valve element 2 such that the valve element 2 moves to the direction of separating from the valve element mounting hole 103. When the adjustment direction of the valve element switch 4 is a direction that the valve element 2 extends into the valve element mounting hole 103, the second matching body 401 on the valve switch moves to the direction of extending into the valve element mounting hole 103 and is separated from the first matching body 203. However, the elastic member 3 is deformed by the axial pressure and thus may apply a force to the valve element 2 to cause the valve element 2 to move to the side of extending into the valve element mounting hole 103 until the first matching body 203 abuts against the second matching body 401 again. The movement of the valve element 2 implements the communication or disconnection between the liquid inlet 101 and the liquid outlet 102.

The elastic member 3 is a spring, and an end thereof acting on the valve element 2 specifically acts on the first matching body 203 protruding from the valve element 2.

The elastic member limiter 403 is an end cover matched with the mounting through hole 402.

Preferably, a mounting opening of the valve element 2 penetrating through the keg head 1 is formed in one end of the valve element mounting hole 103. The valve element switch 4 is in threaded connection to the end, where the mounting opening of the valve element 2 is disposed, of the keg head 1. The valve element switch 4 implements the movable adjustment of the valve element 2 linked with the valve element switch 4 in the valve element mounting hole 103 by thread adjustment with the keg head 1.

With the adoption of the above-mentioned structure, an operator may control the valve element 2 only by rotating the valve element switch 4, so the simplicity and convenience for operation are ensured.

Figure 3:
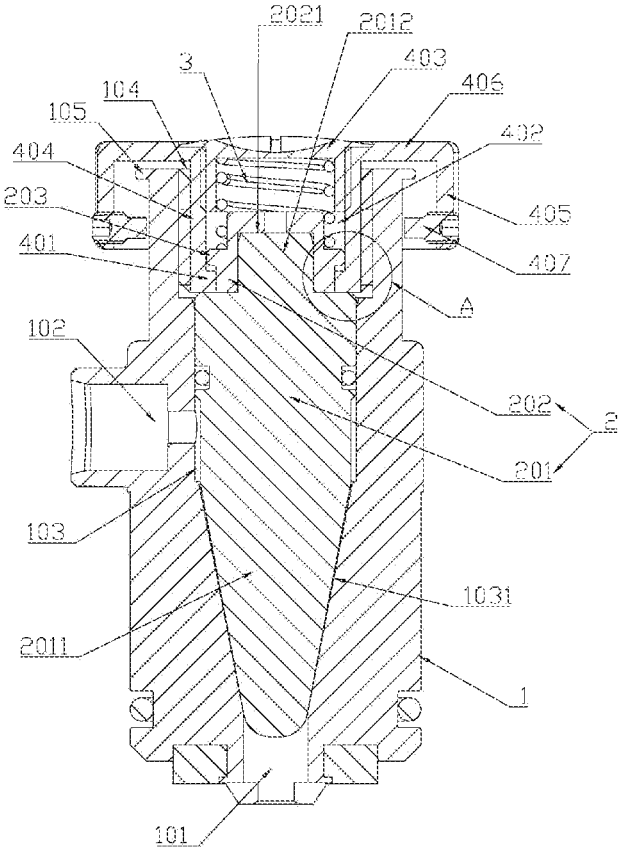
FIG. 3 is a schematic sectional structural diagram of a valve element and a valve element switch in a distributor according to the disclosure herein.
Figure 4:
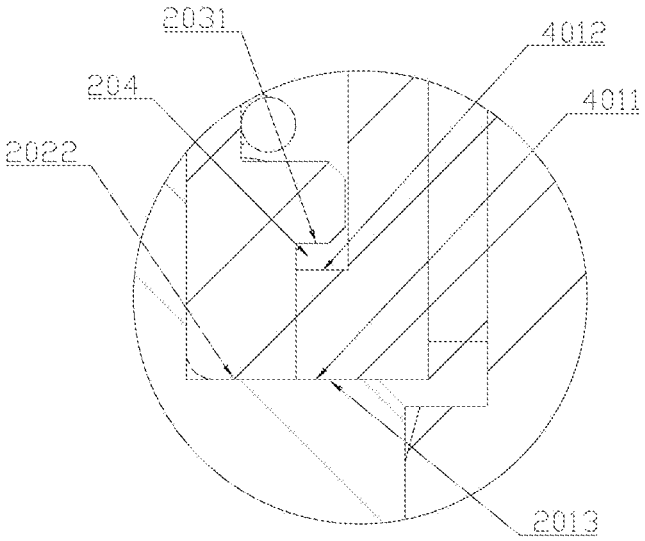
FIG. 4 is an enlarged view of A in FIG. 3.
Figure 5:
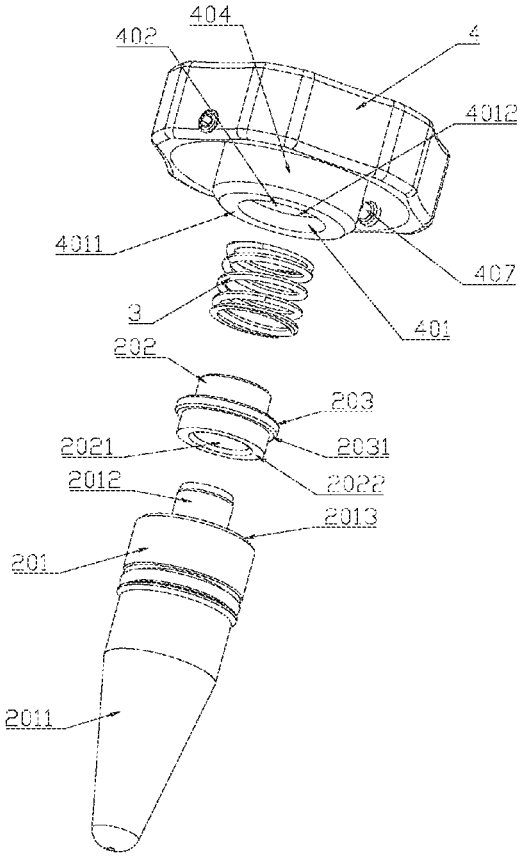
FIG. 5 is a schematic exploded structural diagram of a valve element and a valve element switch in a distributor according to the disclosure herein.

As shown in FIG. 3, preferably, the valve element switch 4 includes a thread fitting portion 404 extending into the valve element mounting hole 103, a switch matching portion 405 outside the keg head 1, and a switch transition portion 406 configured to connect the thread fitting portion 404 with the switch matching portion 405. A thread is disposed on an outer wall of the thread fitting portion 404. A thread matched with the thread of the thread fitting portion 404 is disposed on an inner wall of the valve element mounting hole 103 close to the side of the mounting opening of the valve element 2.

The switch matching portion 405 is provided with a limiting member 407 protruding to an outer wall side of the keg head 1. An outer wall of the keg head 1 protrudes to the side of the switch matching portion 405 to form a limiting portion 105. The limiting portion 105 is located between the limiting member 407 and the switch transition portion 406.

With the adoption of the above-mentioned structure, when the adjustment direction of the valve element switch 4 is a direction that the valve element 2 is separated from the valve element mounting hole 103, the limiting member 407 on the valve element switch 4 may gradually get close to until abutting against the limiting portion 105 of the keg head 1. In a state that the limiting member 407 abuts against the limiting portion 105, the limiting portion 105 limits the limiting member, namely limits the valve element switch 4, such that the valve element switch 4 cannot continue to be adjusted to the direction, and it indicates that the valve element switch 4 has been maximally adjusted to this side.

Specifically, the limiting member adopts a set screw. The set screw penetrates through the switch matching portion 405, and one end is beyond a side of the switch matching portion 405 facing an outer wall of the keg head.

Preferably, at least an end of the control portion 201 away from the switch control portion 201 presents a gradually enlarged tapered structure 2011 along a direction of getting close to the switch connecting portion 202. A matched taper hole is disposed at a position, configured to accommodate the tapered structure 2011 of the control portion 201, of the valve element mounting hole 103.

With the adoption of the above-mentioned structure, when the valve element 2 moves to the side of separating from the valve element mounting hole 103, a gap may be formed between the tapered structure 2011 of the control portion 201 and the taper hole of the valve element mounting hole 103, the liquid inlet 101 is communicated with the liquid outlet 102 through the gap, and positions of the tapered structure 2011 and the taper hole may be adjusted to adjust the size of the gap therebetween, thereby adjusting the flow. When the valve element 2 moves to the side of extending into the valve element mounting hole 103 until the tapered structure 2011 completely fits the taper hole, the liquid inlet 101 cannot be communicated with the liquid outlet 102 through the valve element mounting hole 103.

Specifically, the liquid inlet 101 is provided in a bottom end of the keg head 1. The liquid outlet 102 is provided in a side edge of the keg head 1. The valve element mounting hole 103 is provided in a top end of the keg head 1. The valve element 2 moves up and down in the valve element mounting hole 103 to implement the communication and disconnection of the liquid inlet 101 and the liquid outlet 102.

Preferably, the switch connecting portion 202 is clamped with the control portion 201. A first end face 2022 of the switch connecting portion 202 facing the control portion 201 is sunken to form a clamping groove 2021. A second end face 2013 of the control portion 201 facing the switch connecting portion 202 protrudes to form a clamping protruding block 2012 matched with the clamping groove 2021. The first matching body 203 is disposed on the switch connecting portion 202.

With the adoption of the above-mentioned structure, when being assembled, the valve element switch 4 and the valve element 2 are fixed by the clamping protruding block 2012 and the clamping groove 2021 by arranging the switch connecting portion 202 at first in the mounting through hole 402 such that the first matching body 203 is located on one side of the second matching body 401 and arranging the control portion 201 on the other side of the second matching body 401.

Preferably, an edge of a second end face 2013 of the control portion 201 facing the switch connecting portion 202 is beyond that of a first end face 2022 of the switch connecting portion 202 facing the control portion 201. The second end face 2013 forms a second matching body accommodation groove 204 with a third end face 2031 of the first matching body 203 facing the second end face 2013. An end face of the second matching body 401 facing the second end face 2013 forms a fourth end face 4011. An end face of the second matching body 401 facing the third end face 2031 forms a fifth end face 4012. A distance from the second end face 2013 to the third end face 2031 is greater than that from the fourth end face 4011 to the fifth end face 4012.

With the adoption of the above-mentioned structure, a thickness of the second matching body 401 is smaller than a width of the second matching body accommodation groove 204. That is, the inclination of the second matching body may be adjusted in an accommodation cavity of the second matching body 401 to prevent the valve element 2 from being inclined in the valve element mounting hole 103.

Preferably, the distributor includes a distributor seat 5 and an operating device 6. The distributor seat 5 is provided with a keg head sleeve-connection hole 501 in movable matched sleeve connection to the keg head 1. The operating device 6 is in matched connection to the distributor seat 5 and the keg head 1 respectively. The keg head 1 is driven by the operating device 6 to slide in the keg head sleeve-connection hole 501 to open and close a corresponding keg spear 7.

The keg spear 7 is mounted to a beer outlet 701 of the beer keg. With the adoption of the above-mentioned structure, the distributor is mounted to the keg spear 7. If intended to open the keg spear 7, a user needs to operate the operating device 6 to drive the keg head 1 to open the keg spear 7 and adjust the valve element switch 4 to communicate the liquid inlet 101 with the liquid outlet 102. If intended to close the keg spear 7, the user needs to reversely operate the operating device 6 to drive the keg head 1 to close the keg spear 7.

Figure 8:
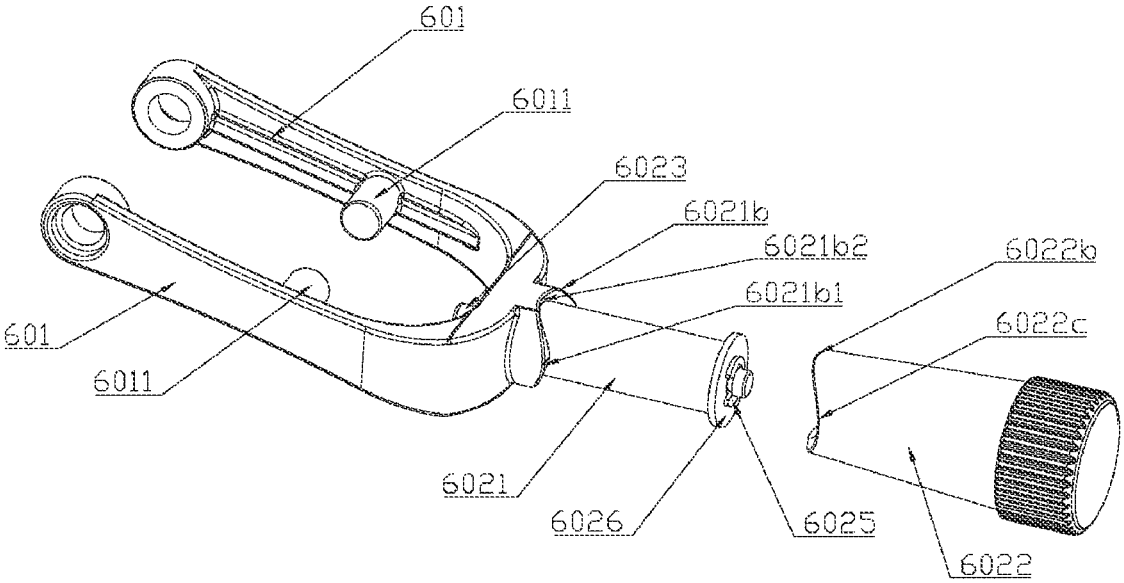
FIG. 8 is a schematic matched structural diagram of a distributor and a keg spear according to the disclosure herein.

As shown in FIG. 8, generally, the keg spear 7 is provided with a beer outlet passage 702 and the beer outlet 701 is formed in the keg spear 7. A bore diameter of the beer outlet 701 is smaller than the beer outlet passage 702. A plug 703 configured to plug the beer outlet 701 and a plug reset member 704 acting on the plug 703 such that the plug moves to a side of plugging the beer outlet 701 are movably disposed in the beer outlet passage 702. When the keg head 1 moves to a side close to the plug 703, the keg head 1 drives the plug 703 to overcome an acting force of the plug reset member 704 to move to a side away from the beer outlet 701 to open the beer outlet 701. When the keg head 1 moves to a side away from the plug 703, the plug 703 moves to a side close to the beer outlet 701 under the action of the plug reset member 704 to plug the beer outlet 701.

Preferably, the operating device 6 includes a driving arm 601 and a handle 602. One end of the driving arm 601 is in matched hinged connection to the distributor seat 5, while the other end is in matched connection to the handle 602. A driving block 6011 is disposed on an inner side wall of the driving arm 601 facing the keg head 1. A driving sliding chute 106 matched with the driving block 6011 is disposed in a side wall of the keg head 1 facing the driving arm 601.

With the adoption of the above-mentioned structure, the operator acts on the handle to drive the driving arm 601 to rotate, and the driving block 6011 slides in the driving sliding chute 106. The driving block 6011 circumferentially moves with the rotation of the driving arm 601 and thus may apply an acting force to a side wall of the driving sliding chute 106 to slide the keg head 1 in the keg head sleeve-connection hole 501 of keg head 1. A support rod 506 configured to be hinged to the driving arm 601 protrudes from the distributor seat 5.

Specifically, there are two driving arms 601 located on two sides of the keg head 1 respectively. Ends, not hinged to the distributor seat 5, of the two driving arms 601 are connected by a driving arm connecting belt 603. The handle is disposed on the driving arm connecting belt 603.

Figure 6:
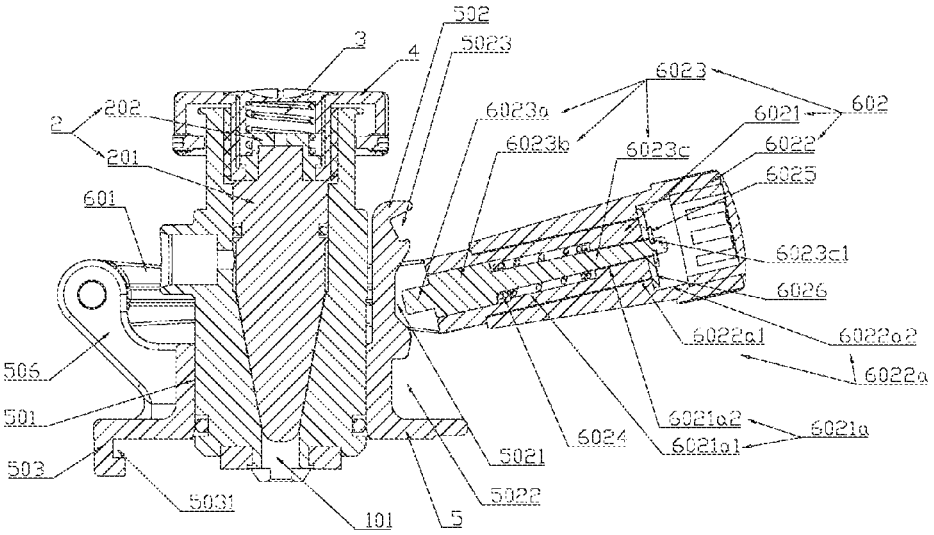
FIG. 6 is a schematic sectional structural diagram of a distributor according to the disclosure herein.
Figure 7:
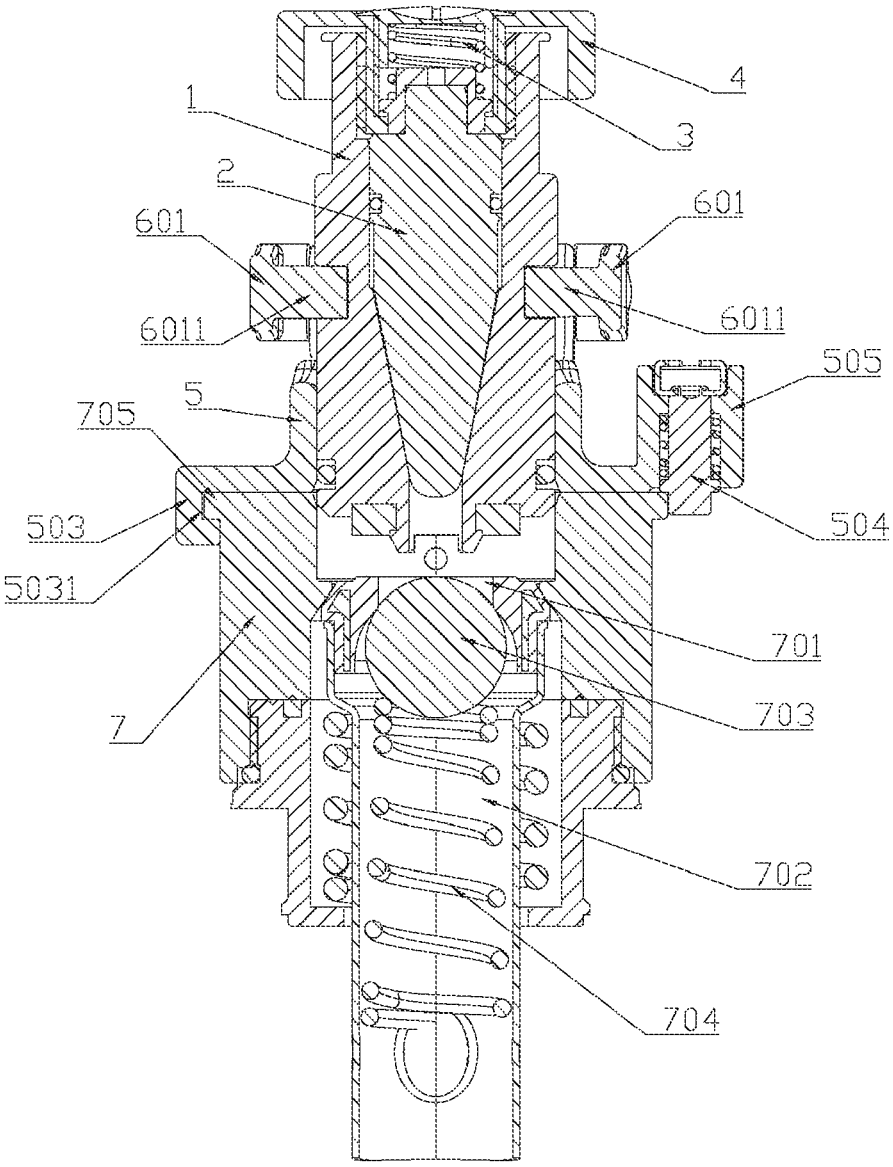
FIG. 7 is a schematic partial exploded structural diagram of an operating device in a distributor according to the disclosure herein.

As shown in FIG. 6, preferably, the handle 602 includes a fixed handle 6021, a movable handle 6022, an ejector rod 6023, and an ejector rod reset member 6024. The fixed handle 6021 is connected to the driving arm 601. The fixed handle 6021 is provided with an ejector rod ferrule hole 6021*a* for sliding of the ejector rod 6023. At least one end of the ejector rod ferrule hole 6021*a* penetrates through the fixed handle 6021 to expose an ejector head 6023*a* of the ejector rod 6023. A surface of a vertically distributed stopping plate 502 is provided at a position of the distributor seat 5 close to the ejector head 6023*a*. At least a first stopping slot 5021 and second stopping slot 5022 which are matched with the ejector head 6023*a* are provided on a side of the stopping plate 502 facing the ejector head 6023*a*.

The movable handle 6022 is connected to the ejector rod 6023 to drive the ejector head 6023*a* of the ejector rod 6023 to get close to or away from the stopping plate 502. The ejector rod reset member 6024 acts on the ejector rod 6023 such that the ejector rod 6023 tends to move to the side of the stopping plate 502.

The operating device 6 drives the keg head 1 to close the keg spear 7 when the ejector head 6023*a* of the ejector rod 6023 is in the first stopping slot 5021.

The operating device 6 drives the keg head 1 to open the keg spear 7 when the ejector head 6023*a* of the ejector rod 6023 is in the second stopping slot 5022.

With the adoption of the above-mentioned structure, the first stopping slot 5021 and the second stopping slot 5022 are matched with the ejector head 6023*a* of the ejector rod 6023 to lock the operating device 6, namely lock the keg head 1.

If intended to switch a state of the operating device 6, namely switch a state of the keg head 1, the operator needs to operate the movable handle at first to drive the ejector rod 6023 to overcome an acting force of the ejector rod reset member 6024 such that the ejector head 6023*a* moves to a side away from the stopping plate 502 until the ejector head 6023*a* is separated from the first stopping slot 5021 or the second stopping slot 5022. In such case, the operating device 6 is unlocked, and the operator may operate the operating device 6 to drive the keg head 1. After the operation, the movable handle is released, and the ejector rod 6023 moves to a side close to the stopping plate 502 under the action of an acting force of the ejector rod reset member 6024 until the ejector head 6023*a* reenters the first stopping slot 5021 or the second stopping slot 5022 to re-lock the operating device 6.

Preferably, the movable handle 6022 is provided with a handle ferrule hole 6022*a*. The movable handle 6022 is in sleeve connection outside the fixed handle 6021 by the handle ferrule hole 6022*a*.

Specifically, the ejector rod ferrule hole 6021*a* includes a first ejector rod ferrule hole 6021*a*1 with a large bore diameter and a second ejector rod ferrule hole 6021*a*2 with a small bore diameter. The ejector rod 6023 includes the ejector head 6023*a*, a large cylindrical section matched with the first ejector rod ferrule hole 6021*a*1 and a small cylindrical section 6023*c* matched with the second ejector rod ferrule hole 6021*a*2, which are coaxially connected into a whole in sequence. A snap spring slot 6023*c*1 is disposed in a tail end of the small cylindrical section 6023*c*. After the ejector rod 6023 penetrates through the ejector rod ferrule hole 6021*a*, tail ends of the snap spring slot 6023*c*1 and the fixed handle 6021 are sleeved with a gasket 6026 and limited by a snap spring 6025 clamped into the snap spring slot 6023*c*1. An external diameter of the gasket 6026 is larger than that of the fixed handle 6021. The ejector rod reset member 6024 is located between a bottom end of the first ejector rod ferrule hole 6021*a*1 and the large cylindrical section 6023*b* and in matched sleeve connection to the small cylindrical section 6023*c*. The handle ferrule hole 6022*a* includes a first handle ferrule hole 6022*a*1 matched with the external diameter of the fixed handle 6021 and a second handle ferrule hole 6022*a*2 of which a bore diameter is larger than that of the first handle ferrule hole 6022*a*1. The bore diameter of the second handle ferrule hole 6022*a*2 is matched with the external diameter of the gasket 6026.

With the adoption of the above-mentioned structure, when the operator pulls the movable handle 6022 to the side away from the stopping plate 502, since the bore diameter of the second handle ferrule hole 6022*a*2 is larger than that of the first handle ferrule hole 6022*a*1, a step surface is formed to apply an acting force to the gasket 6026 to cause the ejector rod 6023 to overcome an acting force of the ejector rod reset member 6024 to move to the side away from the stopping plate 502. After the operator releases the movable handle 6022, the ejector rod reset member 6024 acts on the large cylindrical section 6023*b* such that the ejector rod 6023 moves to the side close to the stopping plate 502. The ejector rod 6023 stops moving when the gasket 6026 contacts with the tail end of the fixed handle 6021.

Preferably, an end face at an opening of the handle ferrule hole 6022*a* circumferentially protrudes to form a first cambered bump 6022*b*, and is circumferentially sunken to form a first cambered recess 6022*c*. The first cambered bump 6022*b* is connected to the first cambered recess 6022*c* with a smooth transition formed at a junction. The fixed handle 6021 protrudes at the opening of the handle ferrule hole 6022*a* to form a matching surface 6021*b* contacting with the end face at the opening of the handle. The matching surface 6021*b* circumferentially protrudes to form a second cambered bump 6021*b*1 matched with the first cambered recess 6022*c*, and is circumferentially sunken to form a second cambered recess 6021*b*2 matched with the first cambered bump 6022*b*.

With the adoption of the above-mentioned structure, the operator only needs to rotate the movable handle 6022 such that a peak of the first cambered bump 6022*b* slides to be opposite to that of the second cambered bump 6021*b*1, and the movable handle 6022 may naturally slide along the fixed handle 6021 and drive the ejector rod 6023 to overcome the acting force of the ejector rod reset member 6024 to move. After the operator releases the movable handle 6022, the ejector rod 6023 is reset under the acting force of the ejector rod reset member 6024 and drives the movable handle 6022 to rotate such that the peak of the first cambered bump 6022*b* slides to be opposite to a trough of the second cambered recess 6021*b*2 and slides along a direction opposite to the fixed handle 6021. The above-mentioned operating manner is more labor-saving.

Figure 2:
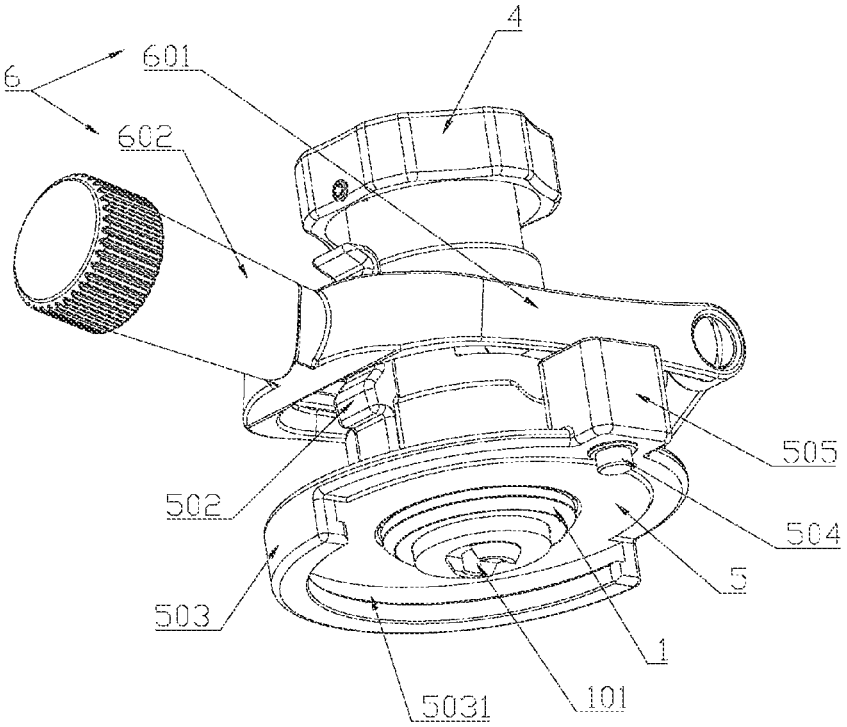
FIG. 2 is a schematic three-dimensional structural diagram of a distributor from another angle according to the disclosure herein.

As shown in FIGS. 2 and 8, preferably, a cambered buckling plate 503 is disposed at a bottom end of the distributor seat 5. The cambered buckling plate 503 is provided with a cambered buckling groove 5031 horizontally matched and buckled with an annular step 705 on a side edge of a top surface of the keg spear 7. The distributor seat 5 is provided with an inserted pin 504 at a position where the cambered buckling plate 503 is not disposed. The inserted pin 504 is slidably mounted to the distributor seat 5. An extending surface of a cambered surface of the cambered buckling groove 5031 is tangent to a lateral surface of the inserted pin 504. The distributor seat 5 is provided with an inserted pin seat 505 at a position where the inserted pin 504 is disposed.

With the adoption of the above-mentioned structure, the operator operates the inserted pin 504 to make a bottom surface thereof not beyond that of the distributor seat 5, then causes the bottom end of the distributor seat 5 to abut against the top surface of the keg spear 7, and slides the distributor seat 5 to clamp the annular step 705 on the keg spear 7 into the cambered buckling groove 5031. The inserted pin 504 is operated to make the bottom surface thereof beyond that of the distributor seat 5 and the lateral surface thereof tangent to the annular step 705 of the keg spear 7, to implement the connection between the distributor and the keg spear 7. By the above-mentioned structure, the distributor may further rotate 360 degrees on the keg spear 7 to adjust the position of the liquid outlet 102. If the distributor needs to be separated from the keg spear 7, it is only necessary to operate the inserted pin 504 again to make the bottom surface thereof not beyond the bottom end of the distributor seat 5 and slide the distributor seat 5 to separate the annular step 705 on the keg spear 7 from the cambered buckling groove 5031, to separate the distributor seat 5 from the keg spear 7.

Preferably, a bottom surface of the keg head 1 is beyond that of the distributor seat 5 when the ejector head 6023*a* of the ejector rod 6023 is in the first stopping slot 5021 or the second stopping slot 5022. A third stopping slot 5023 is further provided on a side of the stopping plate 502 facing the ejector head 6023*a*. The bottom surface of the keg head 1 is not beyond that of the distributor seat 5 when the ejector head 6023*a* of the ejector rod 6023 is in the third stopping slot 5023.

With the adoption of the above-mentioned structure, the bottom surface of the keg head 1 is not beyond that of the distributor seat 5 when the operator operates the movable handle to locate the ejector head 6023*a* in the third stopping slot 5023. In such case, when the distributor seat 5 is mounted to the keg spear 7 or dismounted from the keg spear 7, the influence of the keg head 1 on the above-mentioned process is avoided.

The above is only the preferred implementations of the disclosure herein. It is to be pointed out that those of ordinary skill in the art may further make a plurality of improvements and embellishments without departing from the technical principle of the disclosure herein, and these improvements and embellishments should also fall within the scope of protection of the disclosure herein.

What is claimed is:

1. A distributor, comprising a keg head (1), a valve element (2), an elastic member (3), and a valve element switch (4) configured to control the valve element (2) to act, wherein the keg head (1) is provided with a liquid inlet (101) in fluid communication with a beer keg, a liquid outlet (102) configured for liquid to flow out, and a valve element mounting hole (103) matched with the valve element (2); the liquid inlet (101) and the liquid outlet (102) are communicated with the valve element mounting hole (103) respectively to implement the communication of the liquid inlet (101) and the liquid outlet (102) through the valve element mounting hole (103); the valve element (2) comprises a control portion (201) movably mounted in the valve element mounting hole (103) to control the communication or disconnection between the liquid inlet (101) and the liquid outlet (102) and a switch connecting portion (202) configured to be connected to the valve element switch (4); and the valve element (2) is provided with a first matching body (203), the valve element switch (4) is provided with a second matching body (401) matched with the first matching body (203), and the elastic member (3) acts on the valve element (2) such that the first matching body (203) tends to move to abut against the second matching body (401).

2. The distributor according to claim 1, wherein the valve element switch (4) is provided with a mounting through hole (402), the switch connecting portion (202) extends into the mounting through hole (402) from an opening in one end of the mounting through hole (402), a side wall of the switch connecting portion (202) protrudes to an inner wall side of the mounting through hole (402) to form the first matching body (203), an inner wall of the mounting through hole (402) protrudes to an outer wall side of the switch connecting portion (202) to form the second matching body (401), and the second matching body (401) is located between the first matching body (203) and the control portion (201); and an elastic member limiter (403) is disposed in an opening in the other end of the mounting through hole (402), and two ends of the elastic member (3) are pressed against the valve element (2) and the elastic member limiter (403) respectively such that the elastic member (3) is deformed by axial pressure.

3. The distributor according to claim 1, wherein a mounting opening of the valve element (2) penetrating through the keg head (1) is formed in one end of the valve element mounting hole (103), the valve element switch (4) is in threaded connection to the end, where the mounting opening of the valve element (2) is disposed, of the keg head (1), and the valve element switch (4) implements the movable adjustment of the valve element (2) linked with the valve element switch (4) in the valve element mounting hole (103) by thread adjustment with the keg head (1).

4. The distributor according to claim 3, wherein the valve element switch (4) comprises a thread fitting portion (404) extending into the valve element mounting hole (103), a switch matching portion (405) outside the keg head (1), and a switch transition portion (406) configured to connect the thread fitting portion (404) with the switch matching portion (405), a thread is disposed on an outer wall of the thread fitting portion (404), and a thread matched with the thread of the thread fitting portion (404) is disposed on an inner wall of the valve element mounting hole (103) close to the side of the mounting opening of the valve element (2); and the switch matching portion (405) is provided with a limiting member (407) protruding to an outer wall side of the keg head (1), an outer wall of the keg head (1) protrudes to the side of the switch matching portion (405) to form a limiting portion (105), and the limiting portion (105) is located between the limiting member (407) and the switch transition portion (406).

5. The distributor according to claim 1, wherein at least an end of the control portion (201) away from the switch control portion (201) presents a gradually enlarged tapered structure (2011) along a direction of getting close to the switch connecting portion (202); and a matched taper hole is disposed at a position, configured to accommodate the tapered structure (2011) of the control portion (201), of the valve element mounting hole (103).

6. The distributor according to claim 1, wherein the switch connecting portion (202) is clamped with the control portion (201); and a first end face (2022) of the switch connecting portion (202) facing the control portion (201) is sunken to form a clamping groove (2021), and a second end face (2013) of the control portion (201) facing the switch connecting portion (202) protrudes to form a clamping protruding block (2012) matched with the clamping groove (2021).

7. The distributor according to claim 2, wherein an edge of a second end face (2013) of the control portion (201) facing the switch connecting portion (202) is beyond that of a first end face (2022) of the switch connecting portion (202) facing the control portion (201), the second end face (2013) forms a second matching body accommodation groove (204) with a third end face (2031) of the first matching body (203) facing the second end face (2013), an end face of the second matching body (401) facing the second end face (2013) forms a fourth end face (4011), an end face of the second matching body (401) facing the third end face (2031) forms a fifth end face (4012), and a distance from the second end face (2013) to the third end face (2031) is greater than that from the fourth end face (4011) to the fifth end face (4012).

8. The distributor according to claim 1, comprising a distributor seat (5) and an operating device (6), wherein the distributor seat (5) is provided with a keg head sleeve-connection hole (501) in movable matched sleeve connection to the keg head (1), the operating device (6) is in matched connection to the distributor seat (5) and the keg head (1) respectively, and the keg head (1) is driven by the operating device (6) to slide in the keg head sleeve-connection hole (501) to open and close a corresponding keg spear (7).

9. The distributor according to claim 8, wherein the operating device (6) comprises a driving arm (601) and a handle (602); one end of the driving arm (601) is in matched hinged connection to the distributor seat (5), while the other end is in matched connection to the handle (602); a driving block (6011) is disposed on an inner side wall of the driving arm (601) facing the keg head (1), and a driving sliding chute (106) matched with the driving block (6011) is disposed in a side wall of the keg head (1) facing the driving arm (601);

the handle (602) comprises a fixed handle (6021), a movable handle (6022), an ejector rod (6023), and an ejector rod reset member (6024); the fixed handle (6021) is connected to the driving arm (601), the fixed handle (6021) is provided with an ejector rod ferrule hole (6021*a*) for sliding of the ejector rod (6023), at least one end of the ejector rod ferrule hole (6021*a*) penetrates through the fixed handle (6021) to expose an ejector head (6023*a*) of the ejector rod (6023), a surface of a vertically distributed stopping plate (502) is provided at a position of the distributor seat (5) close to the ejector head (6023*a*), at least a first stopping slot (5021) and second stopping slot (5022) which are matched with the ejector head (6023*a*) are provided on a side of the stopping plate (502) facing the ejector head (6023*a*);

the movable handle (6022) is connected to the ejector rod (6023) to drive the ejector head (6023*a*) of the ejector rod (6023) to get close to or away from the stopping plate (502), and the ejector rod reset member (6024) acts on the ejector rod (6023) such that the ejector rod (6023) tends to move to the side of the stopping plate (502);

the operating device (6) drives the keg head (1) to close the keg spear (7) when the ejector head (6023*a*) of the ejector rod (6023) is in the first stopping slot (5021); and the operating device (6) drives the keg head (1) to open the keg spear (7) when the ejector head (6023*a*) of the ejector rod (6023) is in the second stopping slot (5022).

10. The distributor according to claim 9, wherein the movable handle (6022) is provided with a handle ferrule hole (6022*a*), the movable handle (6022) is in sleeve connection outside the fixed handle (6021) by the handle ferrule hole (6022*a*), an end face at an opening of the handle ferrule hole (6022*a*) circumferentially protrudes to form a first cambered bump (6022*b*); and the fixed handle (6021) protrudes at the opening of the handle ferrule hole (6022*a*) to form a matching surface (6021*b*) contacting with the end face at the opening of the handle, and the matching surface (6021*b*) circumferentially protrudes to form a second cambered bump (6021*b*l).

* * * * *